US006078141A

United States Patent [19]

Hoh

[11] Patent Number: 6,078,141

[45] Date of Patent: Jun. 20, 2000

[54] MAGNETRON WITH IMPROVED VANES

[75] Inventor: Jung-eui Hoh, Suwon, Rep. of Korea

[73] Assignee: Samsung Electronics Co., Ltd., Suwon, Rep. of Korea

[21] Appl. No.: 09/076,836

[22] Filed: May 13, 1998

[30] Foreign Application Priority Data

Nov. 4, 1997 [KR] Rep. of Korea ..... 97-57847
Nov. 4, 1997 [KR] Rep. of Korea ..... 97-57848

[51] Int. Cl.[7] ..... H01J 25/50; H01J 23/02

[52] U.S. Cl. ..... 315/39.75; 315/39.51

[58] Field of Search ..... 315/39.75, 39.73, 315/39.69, 39.51

[56] References Cited

U.S. PATENT DOCUMENTS 5,680,012 10/1997 Walker et al. ..... 315/39.73

FOREIGN PATENT DOCUMENTS 55-102155 1/1954 Japan .
55-133560 5/1955 Japan .
52-110565 9/1977 Japan .
57-202042 10/1982 Japan .
59-8244 1/1984 Japan .
1-1898827 7/1989 Japan .
248427 10/1989 Japan ..... 315/39.75
94-5989 8/1994 Rep. of Korea .
724268 2/1955 United Kingdom .
725357 3/1955 United Kingdom .
2 087 143 5/1982 United Kingdom .
2 274 198 7/1994 United Kingdom .

*Primary Examiner*—Benny T. Lee
*Attorney, Agent, or Firm*—Burns, Doane, Swecker & Mathis, L.L.P.

[57] ABSTRACT

A magnetron includes a positive polar section having a positive polar cylinder, a plurality of vanes arranged at equal distance to radially protrude from an inner wall to a predetermined radius of the positive polar cylinder and plural strip rings electrically connecting the alternately-disposed vanes among the plural vanes, and a negative polar section having by a filament having a radius smaller than the predetermined radius for emitting thermoelectron to be installed onto a center line of the positive polar cylinder. Respective vanes provide slanted plane or curved plane to allow the area of a plane facing with an adjacent vane to be wider than that of a planar plane parallel with the cylinder axial direction of the positive polar cylinder within the same height of the vanes, thereby increasing capacitance of a cavity resonator formed by adjacent vanes and inner wall of the positive polar cylinder to cut down materials applied and allow for small-sized fabrication.

4 Claims, 6 Drawing Sheets

MAGNETRON WITH IMPROVED VANES

BACKGROUND OF THE INVENTION

1. Field of the Invention

The present invention relates to a magnetron, and more particularly to a magnetron including vanes of a positive polar portion which generates microwaves and have slanted and circular arc shape, thereby capable of reducing materials and decreasing its size.

2. Description of the Prior Art

Generally, a magnetron of a microwave oven is a device for generating microwaves by converting electrical potential energy into a high frequency energy. The magnetron is utilized as a heat source for inciting a frictional heat between molecules during the thawing or cooking of food.

FIG. 1 shows a vertical section structure of a magnetron generally used for a microwave oven. A negative polar portion includes a filament 10 disposed at the center line. Filament 10 is supported by a center lead 14 and a side lead 18. Center lead 14 is connected to one end of filament 10 via an upper shield 12 and a side lead 18 is connected to the other end of filament 10 via a lower shield 16. A positive polar portion includes a positive polar cylinder 20 and a plurality of vanes 22. Vanes 22 protrude from the inner wall of positive polar cylinder 20 apart from filament 10. Vanes 22 comprise two groups of alternating vanes, one group interconnected by an outer strap ring 24, and the other group interconnected by an inner strap ring 26. Annular permanent magnets 28 and 30 are installed to the upper and lower sides of positive cylinder 20. Magnetic fluxes flow from upper permanent magnet 28 to lower permanent magnet 30 via an activating space 32 secured between filament 10 and vanes 22 so that a uniform magnetic field is formed in the cylindrical axial direction. A magnetic circuit includes magnet members such as upper permanent magnet 28, an upper yoke 34, a lower yoke 36, lower permanent magnet 30, etc. Electrons emitted from filament 10 of a negative potential flow toward the radially inward facing surfaces of positive vanes 22 of a ground potential. Electrons circulate in activating space 32 due to the Lorentz force created by the electric field making a right angle with a magnetic field. By doing so, the electric field of high frequency reaches the radically inward facing end of positive vanes 22 to generate high frequency oscillation in a cavity resonator in the positive inner circumference. A high frequency voltage generated as described above radiates the microwaves produced by a high frequency electric field via an antenna lead 38.

As described above, the high frequency oscillation is affected by the resonant frequency of the cavity resonator. The resonant frequency is influenced by the size of a cavity formed by a pair of adjacent vanes 22 and inner wall of positive cylinder 20.

FIG. 2 illustrates a plan structure of positive polar cylinder 20 and vanes 22, and FIG. 3 illustrates a vertical section structure of vanes 22 along line 2–2' of FIG. 2. Vanes 22 are radially extending from the inner wall of positive polar cylinder 20 toward the center. Therefore, the cavity resonator is formed by a cavity 39 defined by each pair of vanes and inner wall of positive polar cylinder 20. The inductance of the cavity resonator is affected by a length L of the pair of vanes extending from a root portion 21 to an end portion 23, and a capacitance is affected by plane areas of adjacent vanes facing with each other. The longer the vane, the higher the inductance; and, the larger the area of the vane, the higher the capacitance. The resonant frequency is inversely proportional to the square root of the multiplication of inductance and capacitance. For this reason, as the size of the vane is decreased, the resonant frequency becomes increased.

The magnetron is set at a regular resonant frequency, in which, in order to create the set resonant frequency, the positive cylinder and vanes are designed to have predetermined dimensions. Furthermore, the positive cylinder and vanes are fabricated by using a highly-purified (i.e., oxygen-free, high conductivity) process for providing a tolerance to high temperature oscillation and vibration. The OFHC process is expensive to raise the cost of the magnetron.

SUMMARY OF THE INVENTION

The present invention has been made to overcome the above described problem of the prior art, therefore it is an object of the present invention to provide a magnetron including vanes having slanted or curved shape so that a positive polar cylinder can be fabricated in a small size to be secured the same area and the cost can be reduced.

It is another object of the present invention to provide a magnetron including vanes having a circular arc shape so that a positive polar cylinder can be fabricated in a small size to be secured the same length and the cost can be reduced.

To achieve the above and other objects of the present invention, a magnetron includes a positive polar section formed by a positive cylinder, a plurality of vanes arranged at equal distance to radially protrude from an inner wall to a predetermined radius of the positive cylinder and a plurality of strip rings electrically connecting the alternately-disposed plurality of vanes among the plurality of vanes, and a negative polar section formed by a filament having a radius smaller than the predetermined radius for emitting thermo-electron to be installed onto a center line of the positive cylinder. Here, respective vanes are curved or slanted for allowing an area of a plane facing with an adjacent vane to have the larger area than a plane which is perpendicular to the inner wall of the positive cylinder.

Preferably, end portion planes of respective vanes circumscribe a coaxial circle formed by arranging the projecting end portions of the plurality of vanes, and respective vanes have root portions attached to the inner wall of the positive cylinder to be thick and then tapered when reaching end portions.

More preferably, respective vanes are formed to have predetermined curved planes in the length and height directions so as to allow the length of the vanes to be longer than the length projecting from the inner wall of the positive cylinder in the perpendicular direction.

As the result, the wider area of the vanes can be secured within the same space to attain sufficient capacitance of the cavity resonator, thereby making it possible to fabricate further minimized positive cylinder.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENTS

Figure 1:
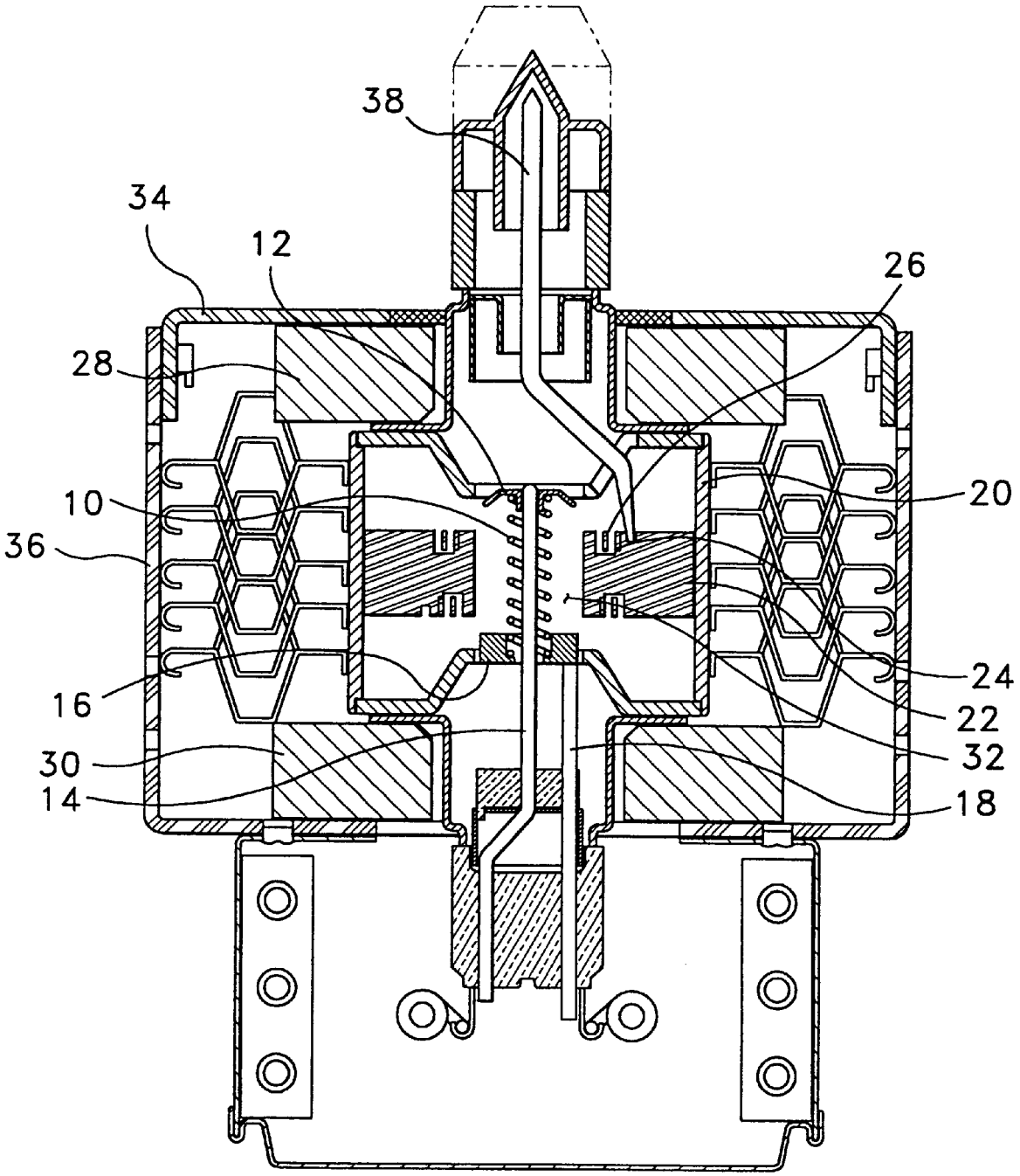
FIG. 1 (PRIOR ART)
FIG. 1 is a sectional view showing the interior of a conventional magnetron employed for a microwave oven.
Figure 2:
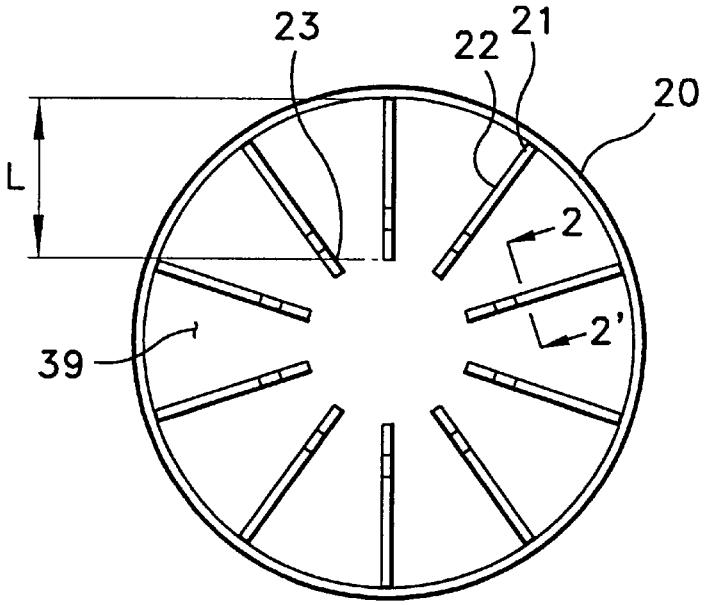
FIG.2 (PRIOR ART)
FIG. 2 is a plan view showing the positive polar cylinder and vanes of the positive polar of FIG. 1.
Figure 3:
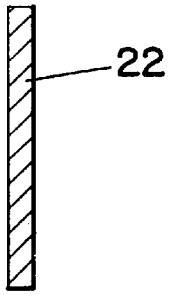
FIG.3 (PRIOR ART)
FIG. 3 is a sectional view taken along line 2–2' of FIG. 2.
Figure 4:
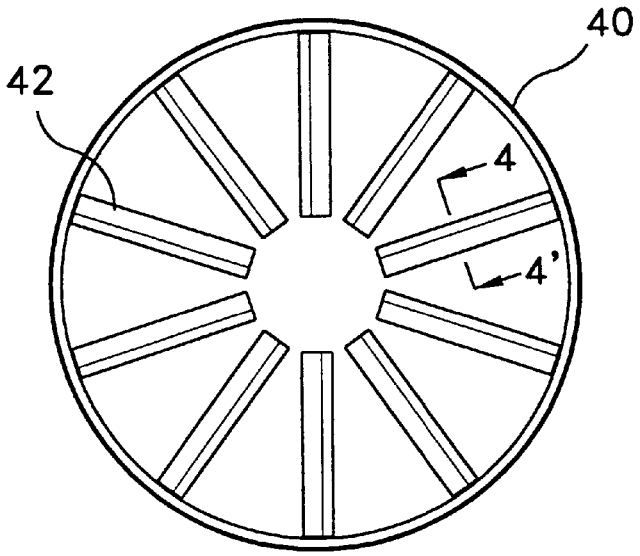
FIG. 4 is a plan view showing a positive polar cylinder and vanes of a positive polar section according to a first embodiment of the present invention.
Figure 5:
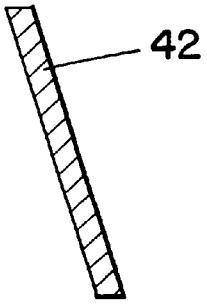
FIG. 5 is a sectional view taken along line 4–4' of FIG. 4.

FIG. 4 illustrates a plan structure of a positive polar cylinder and vanes of a positive polar section according to a first embodiment of the present invention, and FIG. 5 is a vertical section structure of the vanes 42 along line 4–4' of FIG. 4. Vanes 42 of the first embodiment project from the inner wall of positive polar cylinder 40 with a predetermined slanted angle with respect to the cylindrical axial direction. Therefore, as compared with the conventional vertical planar type vanes having the plane parallel with the cylinder axial direction, vanes 42 have a larger area at the same height. Since the larger area is obtained at the same height, the length can be decreased to have the same area, thereby enabling one to reduce the radius of positive polar cylinder 40. While maintaining the same area, the height of positive polar cylinder 40 can be reduced. Due to maintaining the area identically, positive polar cylinder 40 of a small size can be fabricated while the resonant frequency maintains the same value as the typical value.

Figure 6:
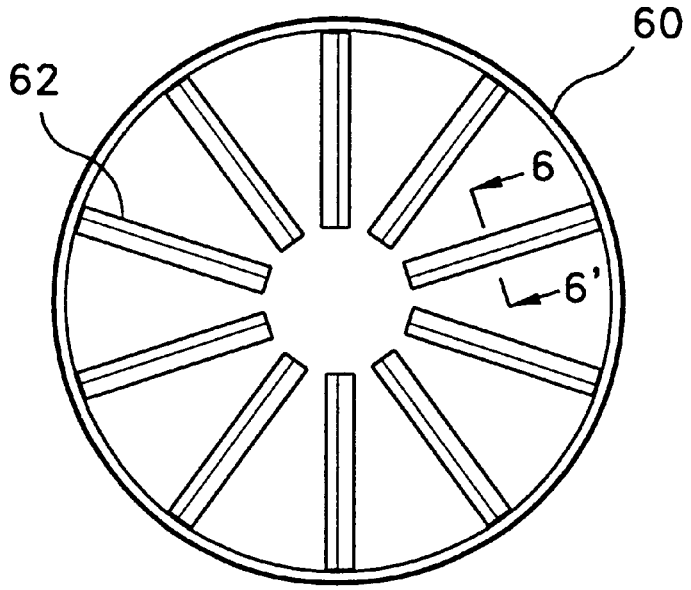
FIG. 6 is a plan view showing the positive polar cylinder and vanes of the positive polar section according to a second embodiment of the present invention.
Figure 7:
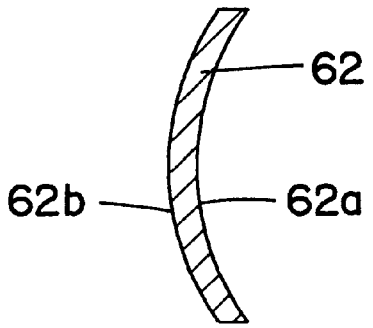
FIG. 7 is a sectional view taken along line 6–6' of FIG. 6.

FIG. 6 shows the plan structure of the positive polar cylinder 60 and vanes 62 of the positive polar section according to a second embodiment of the present invention, and FIG. 7 shows the vertical section structure of the vanes 62 along line 6–6' of FIG. 6. In the second embodiment, vanes 62 are formed to have the curved plane in the lengthwise direction as compared with those of the first embodiment. By doing so, the vane has two opposing circumferentially facing surfaces, one surface 62*a* being concave and the other surface 62*b* being convex as viewed along a radius.

Figure 8:
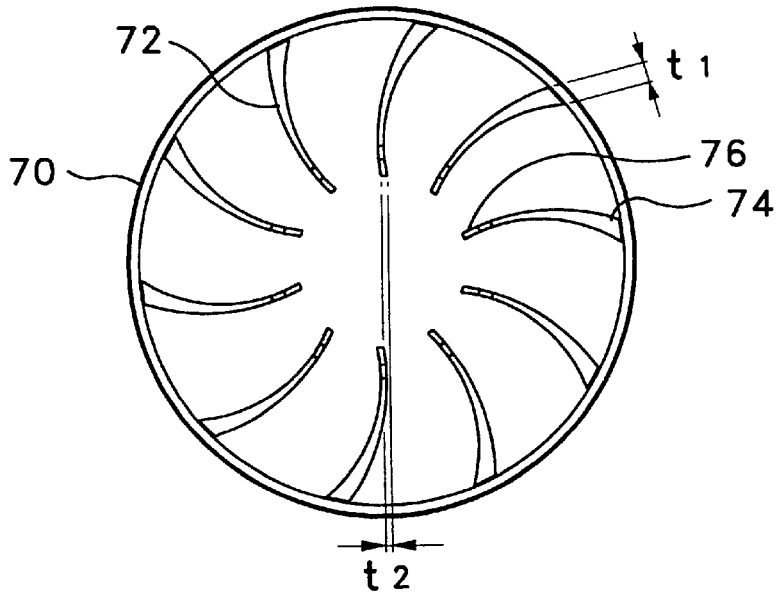
FIG. 8 is a plan view showing the positive polar cylinder and vanes of the positive polar section according to a third embodiment of the present invention.

FIG. 8 shows a plan structure showing the positive polar cylinder and vanes of the positive polar section according to a third embodiment of the present invention. Vanes 72 of the third embodiment do not protrude perpendicularly from the inner wall of positive polar cylinder 70 toward the center, but protrude by forming a predetermined slanted angle with respect to a normal line direction of positive polar cylinder 70 in a manner that an end portion 76 protrudes to be perpendicular to the center. Accordingly, the vane protrudes while drawing an approximately circular arc in the lengthwise direction to have a structure similar to the wing of a turbine. Thus, when the curved vanes perpendicularly protruding to have the same length as compared with the conventional planar type vanes are formed, the length of the curved vanes in the lengthwise direction becomes shorter than that of the planar vanes in the lengthwise direction. By doing so, it is possible to fabricate the positive polar cylinder with a shorter radius. This embodiment makes the positive polar cylinder fabricate in a small size while the resonant frequency maintains its a value same as the typical one.

Also, a thickness t1 of root portion 74 of vane 72 is formed to be thicker than that t2 of end portion 76. This structure facilitates attachment when the vanes and positive polar cylinder are separately molded to be attached via a silver brazing, and improves resonance resisting property.

Figure 9:
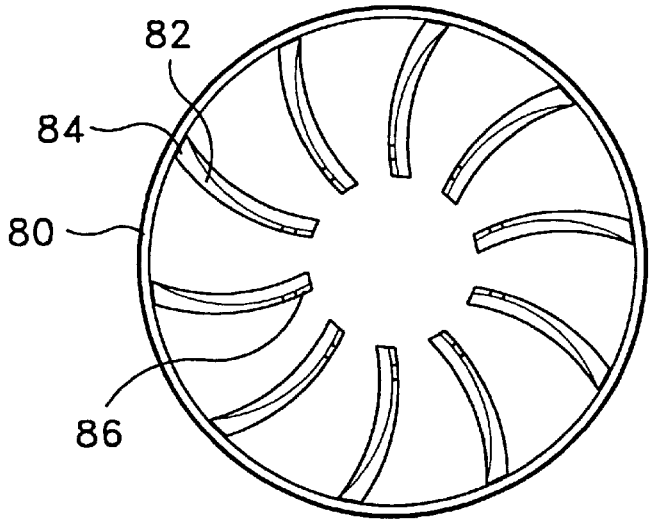
FIG. 9 is a plan view showing the positive polar cylinder and vanes of the positive polar section according to a fourth embodiment of the present invention.

FIG. 9 illustrates a plan structure of the positive polar cylinder and vanes of the positive polar section according to a fourth embodiment of the present invention. The fourth embodiment has a spiral or twisted structure by providing a predetermined angle as reaching an end portion 86 from a root portion 84 attached to the inner wall of positive polar cylinder 80 so as to allow vane 82 to have the curved plane in the height direction as well as the curved structure in the lengthwise direction. That is, the vanes are curved as viewed in a direction parallel to the axis of the cylinder 80. By this construction, the fourth embodiment has the area increased as compared with that of the third embodiment to be capable of increasing the capacitance of the cavity resonator.

Figure 10:
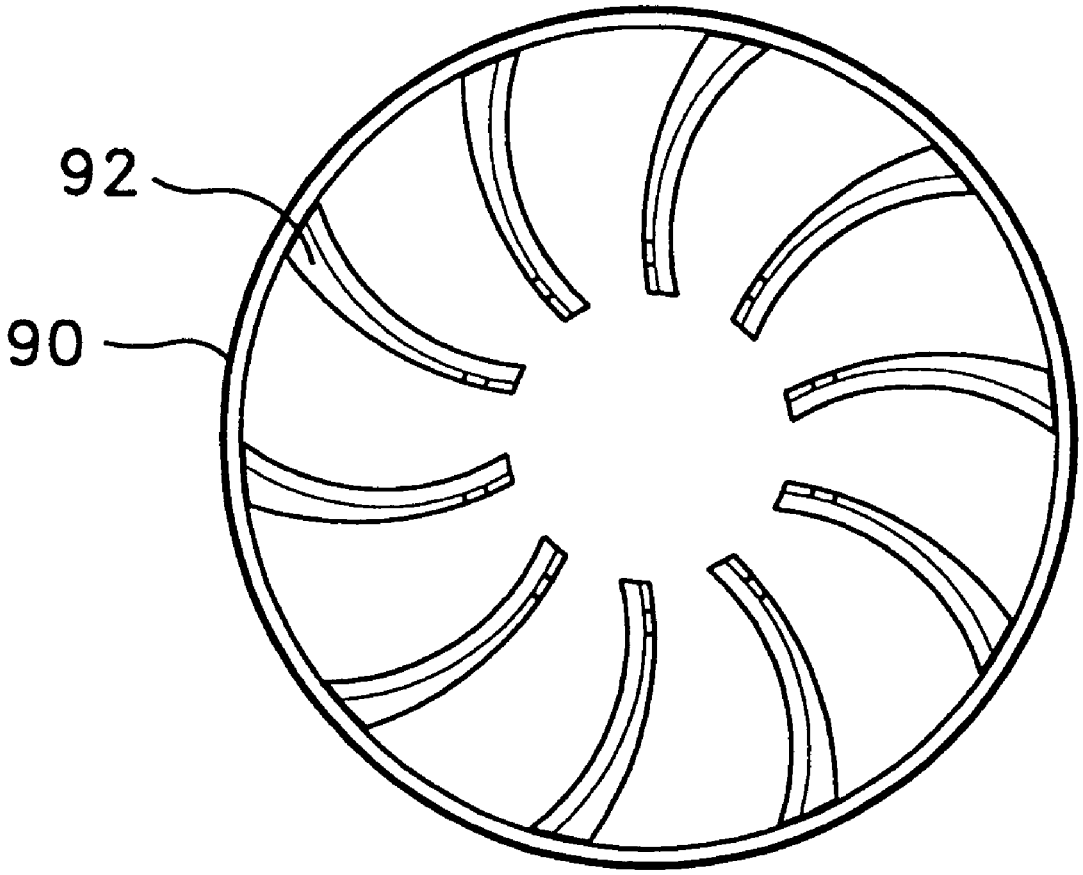
FIG. 10 is a plan view showing the positive polar cylinder and vanes of the positive polar section according to a fifth embodiment of the present invention.

FIG. 10 illustrates a plan structure of the positive polar cylinder and vanes of the positive polar section according to a fifth embodiment of the present invention. The fifth embodiment is different from the fourth embodiment in that the plane of vane 90 is slanted with respect to the inner wall of positive polar cylinder 92 by a predetermined angle. Therefore, this embodiment provides the larger area in the same vertical space when compared with the above-described embodiments to increase the capacitance of the cavity resonator to be the greatest.

By the aforementioned construction and operation, the structure of vanes which form the positive polar section in the magnetron for producing microwaves of a microwave oven is improved for making it possible to reduce the dimensions of the positive polar cylinder while maintaining the same resonating characteristic and efficiency. As the result, small-size and lightweight designing can be accomplished. Furthermore, it is possible to fabricate the positive polar cylinder of small size thereby reduce the cost of the magnetron by the effect of cutting down the high-priced OFHC that is the substance applied.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A magnetron comprising:

a positive polar section including a positive polar cylinder defining an axis and having an inner surface, a plurality of vanes spaced at equal circumferential distances along the inner surface and projecting generally radially inwardly therefrom to a predetermined radius from the axis, and a plurality of strap rings electrically connecting alternate ones of the vanes; and a negative polar section including a filament arranged along the axis and having a radius smaller than the predetermined radius, for emitting thermoelectrons;

each of the vanes respectively having two opposing circumferentially facing surfaces, one surface of each vane being concave in shape and the other surface of each vane being convex in shape, along a radius passing through the respective vane.

2. The magnetron according to claim 1 wherein each vane includes a respective radially inwardly projecting end surface, the end surfaces of all vanes substantially located on a circle having a predetermined radius and arranged coaxially with the axis.

3. The magnetron according to claim 1 wherein each vane has a respective thickness measured along a circumferential direction, the respective thickness of each vane gradually decreasing in a radially inward direction.

4. The magnetron according to claim 1 wherein the opposing circumferentially facing surfaces of each vane are also concave and convex, respectively, in a direction parallel to the axis.

* * * * *